US007207129B2

(12) United States Patent
Buchanan et al.

(10) Patent No.: US 7,207,129 B2
(45) Date of Patent: Apr. 24, 2007

(54) GOLF CART MOUNTED DISPLAY PANEL

(75) Inventors: Mark Alan Buchanan, Grand Junction, CO (US); Kevin D. King, Grand Junction, CO (US)

(73) Assignee: Kevmar Companies, Inc., Grand Junction, CO (US)

( * ) Notice: Subject to any disclaimer, the term of this patent is extended or adjusted under 35 U.S.C. 154(b) by 249 days.

(21) Appl. No.: 10/974,261

(22) Filed: Oct. 26, 2004

(65) Prior Publication Data

US 2005/0086843 A1 Apr. 28, 2005

Related U.S. Application Data

(60) Provisional application No. 60/514,831, filed on Oct. 27, 2003.

(51) Int. Cl.
*G09F 7/00* (2006.01)
*G09F 7/10* (2006.01)

(52) U.S. Cl. ..... 40/611.06

(58) Field of Classification Search ..... 40/611.06, 40/611.01, 611.1, 588, 591, 592, 589, 593, 40/765–767; 411/156
See application file for complete search history.

(56) References Cited

U.S. PATENT DOCUMENTS 1,430,980 A * 10/1922 Gideon ..... 40/611.06
1,790,598 A * 1/1931 Schwartz et al. ..... 40/611.06
1,877,326 A * 9/1932 Schwartz et al. ..... 40/611.06
4,715,138 A * 12/1987 Cherico ..... 40/591
D387,118 S 12/1997 Griffin
5,697,176 A 12/1997 Kuni, Jr. et al.
5,975,390 A 11/1999 Saroli
6,003,255 A * 12/1999 Mahoney et al. ..... 40/611.06
6,029,381 A 2/2000 Aleo et al.
6,148,484 A 11/2000 Andreae, Jr.
6,367,181 B1 * 4/2002 Skoog ..... 40/591
6,523,290 B1 2/2003 Hannan et al.
6,618,974 B2 * 9/2003 Szalay ..... 40/611.06

* cited by examiner

*Primary Examiner*—Robert J. Sandy
(74) *Attorney, Agent, or Firm*—Hensley Kim & Edgington, LLC

(57) ABSTRACT

A display panel for use on a golf cart is composed of layered transparent panels and frame members adhered together. Two transparent panels are separated by a set of spacer members to form a cavity between the transparent panels. The cavity is accessible via an opening at one end of the display panel and is sealed with a removable spacer member inserted between the transparent panels. Two frame members are adhered respectively to each of the two transparent panels. The display panel is mounted to the canopy supports of a golf cart with clamps attached to each end of the display panel.

22 Claims, 7 Drawing Sheets

GOLF CART MOUNTED DISPLAY PANEL

CROSS REFERENCE TO RELATED APPLICATIONS

This application claims the benefit pursuant to 35 U.S.C. § 119(e) of U.S. provisional application No. 60/514,831 filed 27 Oct. 2003, which is hereby incorporated by reference as though fully set forth herein.

BACKGROUND OF THE INVENTION

1. Field of the Invention

This invention relates to a display panel for mounting to canopy supports on a golf cart.

2. Description of the Related Art

The sport of golf has grown significantly over the past decade in terms of public interest and participation as a recreational sport. In many markets there is a lack of capacity in the number of golf courses to handle the increased demand of golfers and securing a tee time is difficult at best. Golf courses are being built at a rate not seen in the past in order to serve a higher per capita percentage of the population.

The typical golfer reflects a high-end demographic with the financial means to afford a wide range of products and services. The golf audience is therefore a market that is very appealing to many businesses for advertising goods and services. Assuming a typical round of golf takes about five hours to play and that most golfers playing twice a week if not more, it would be desirable to present advertising to a golfer during the course of play of a round of golf. The advantage of such advertising is that a message is targeted to a desirable demographic audience that is captive for an extended period of time resulting in a lasting impact. This length of impression likely cannot be found with other media venues, for example, newspaper, magazine, or billboard advertising.

Some devices have been suggested for reaching such an audience on the golf course. One system in particular is described in U.S. Pat. No. 6,367,181. This reference describes a display panel for attaching to a golf cart with two frames in which advertising messages can be displayed. A partitioned frame is sandwiched between two transparent panel sheets, which are held together by screws or bolts through a plurality of holes drilled through the perimeter of the display panel. Significant disadvantages of this system include the exposure of the advertising material to moisture seeping into the display panel through the bolt holes and seams between the frame and transparent panels and other ink and paper degrading weather conditions; the instability of the mounting methodologies; and the difficulty of removing and replacing the advertising messages within the display panel.

The information included in this Background section of the specification, including any references cited herein and any description or discussion thereof, is included for technical reference purposes only and is not to be regarded subject matter by which the scope of the invention is to be bound.

SUMMARY OF THE INVENTION

The present invention is an improved golf cart display panel that is substantially moisture resistant. The golf cart display panel of the present invention further protects the display materials exhibited therein from the damaging effects of solar radiation. In addition, the golf cart display panel is designed to provide simple, easy access to remove and replace the display materials.

In one embodiment of the invention, a golf cart display panel is composed of a first transparent panel, a second transparent, at least one fixed spacer member positioned between the first transparent panel and the second transparent panel and a removable spacer member functionally positioned between the first transparent panel and the second transparent panel. The first transparent panel is adhered to a perimeter of the at least one fixed spacer member. The second transparent panel is adhered to the perimeter of the at least one fixed spacer member. A cavity is defined between the first transparent panel, the second transparent panel, and the at least one fixed spacer member. The removable spacer member seals the cavity when positioned between the first transparent panel and the second transparent panel and affords access to the cavity when removed from between the first transparent panel and the second transparent panel.

The golf cart display panel may further be composed of a first frame member and a second frame member. The first frame member is adhered to the first transparent panel opposite the at least one fixed spacer member. The second frame member is adhered to the second transparent panel opposite the at least one fixed spacer member. In addition the golf cart display panel may also be composed of a first clamp attached to a first lateral end of the display panel and a second clamp attached to a second lateral end of the display panel.

In another embodiment of the invention, a weather-resistant golf cart display panel is composed of an elongate container having opposing transparent walls. The elongate container defines a cavity accessible via a single opening in one lateral end of the elongate container. The cavity is adapted to house a flat display sheet. Excepting the single opening, the elongate container is impervious to moisture. A spacer member is adapted for insertion into the single opening. The spacer member substantially seals the cavity from ingress of moisture. A pair of clamps are attached respectively to each lateral end of the elongate container and are adapted to connect to a canopy support of a golf cart.

In yet another embodiment, the invention is directed to a method for removing and replacing a display sheet within a golf cart display panel. In this method a single frame member is removed from the display panel. The display sheet is withdrawn from within a cavity in the display panel through an opening into the cavity formed by removal of the single frame member. A new display sheet is inserted into the cavity. The single frame member is then replaced in the display panel.

Other features, details, utilities, and advantages of the present invention will be apparent from the following more particular written description of various embodiments of the invention as further illustrated in the accompanying drawings and defined in the appended claims.

DETAILED DESCRIPTION OF THE INVENTION

The present invention is directed to an improved display panel for attachment to a golf cart. The display panel may be used to provide advertising, identification, or other information to golfers riding the cart, to other golfers on the course, or to the public in general.

Figure 1:
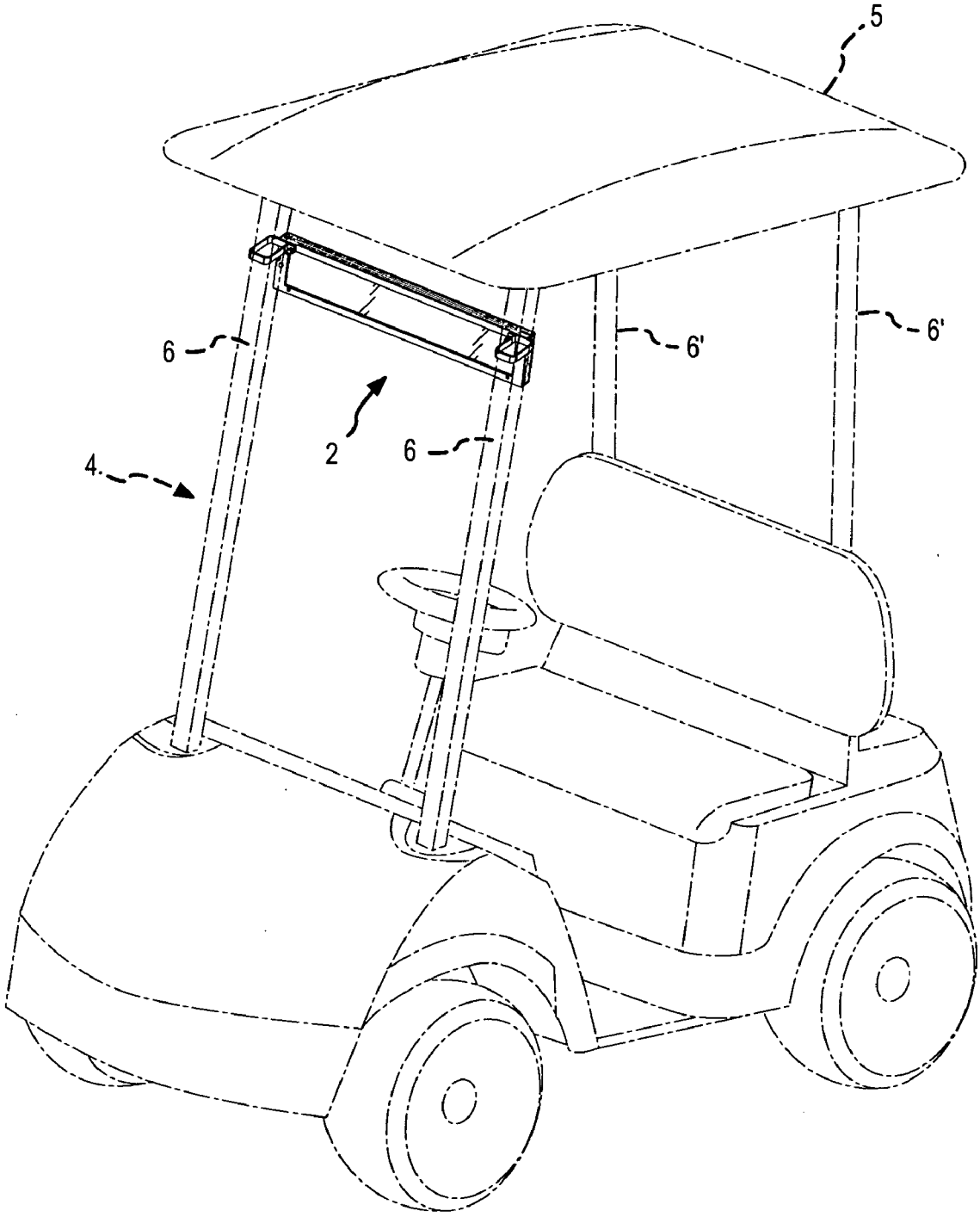
FIG. 1 is an isometric view of a golf cart with a display panel according to one embodiment of the present invention.
Figure 2:
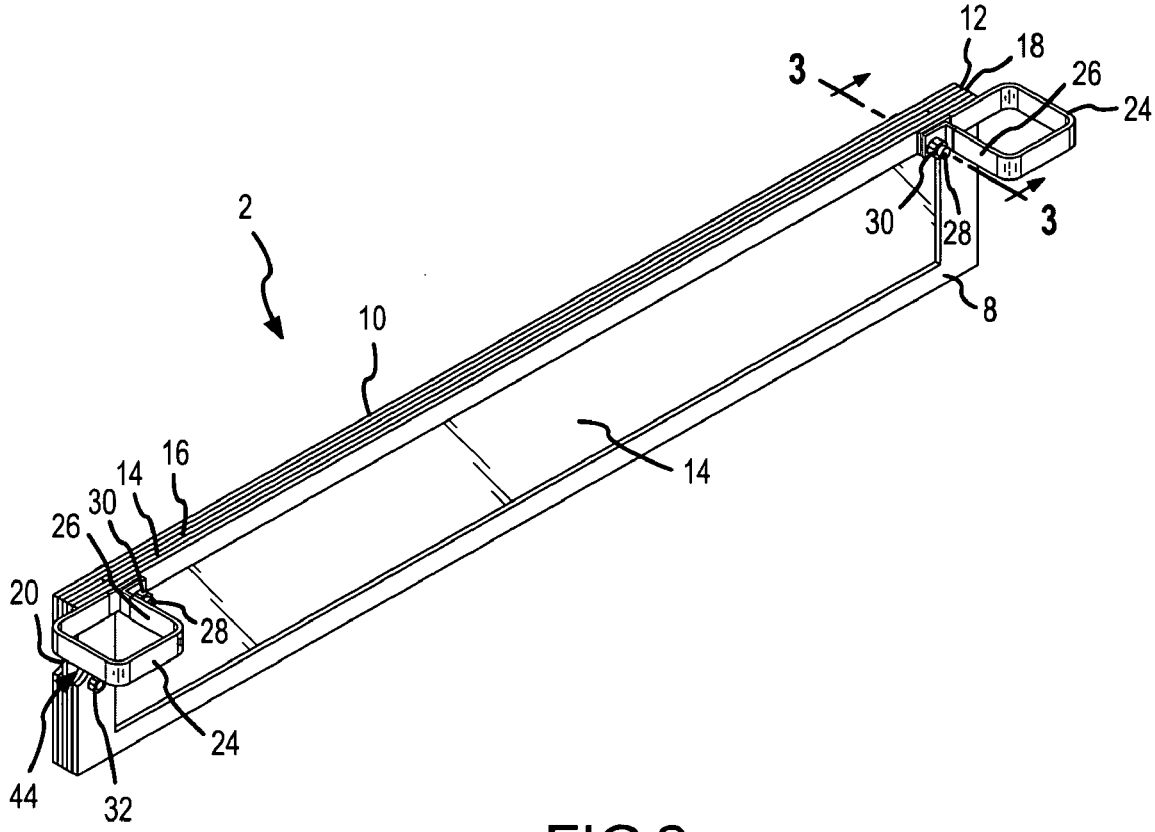
FIG. 2 is an isometric view of the display panel of FIG. 1.
Figure 3:
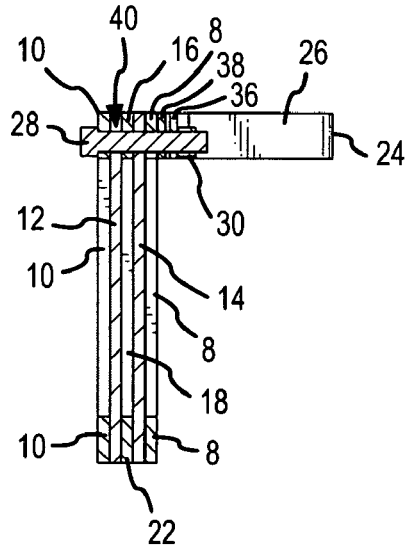
FIG. 3 is a cross-section of the display panel taken along the line 3—3 in the direction indicated in FIG. 2.

As shown in FIG. 1, a display panel 2 according to one embodiment of the present invention may be mounted to a pair of canopy supports 6 on a golf cart 4. Generally, a pair of canopy supports 6 extend upward from the front of the golf cart 4 to support the front edge of the canopy 5 or roof of the golf cart 4. (All references to direction used herein are made with respect to the golf cart 4 as viewed from the front end. Therefore, the "right" is the side with the steering wheel.) Similarly, a second pair of canopy supports 6' extend vertically from the rear of the golf cart 4, usually from behind the seat-back in order to support the rear of the canopy 6. The display panel 2 of the present invention spans the width of the canopy supports and is mounted at each lateral end to a respective canopy support 6.

It should be apparent from FIG. 1, although not explicitly shown, that the display panel 2 may be mounted at any point along the height of the canopy supports 6. However, it is desirable at the display panel 2 not interfere with the field of vision of a golfer driving the golf cart 4. Therefore, the display panel 2 is preferably located either at the top of the canopy supports 6 near the canopy 5 like a visor or below the height of the steering wheel, thereby affording the golfer driving the golf cart 4 a clear field of vision. Alternatively, although perhaps less desirable, the display panel 2 may be mounted at any point along the height of the rear canopy supports 6', most likely adjacent the canopy 5 in order not to be obscured by any golf bags secured to the rear of the golf cart 4.

The assembly of the display panel 2 and its various components are shown in greater detail in FIGS. 2–10B. The display panel 2 is primarily composed of a front frame member 8, a rear frame member 10, a rear transparent panel 12, a front transparent panel 14, and a collection of spacer members. As shown to good advantage in FIG. 4, the spacer members include a top spacer member 16, a right spacer member 18, a left spacer member 20, and a bottom spacer member 22. The display panel 2 is also provided with a pair of support clamps 24 affixed to the top lateral edges of the front side of the display panel 2. In this embodiment, the display panel 2 is configured as an elongate rectangle of a width long enough to span the distance between the front canopy supports 6 of the golf cart 4. The height of the display panel 2 is significantly less than its width and may be chosen to be of a height adequate for presentation of display material, but not too tall so as to obscure the view of the driver of the golf cart 4.

Figure 4:
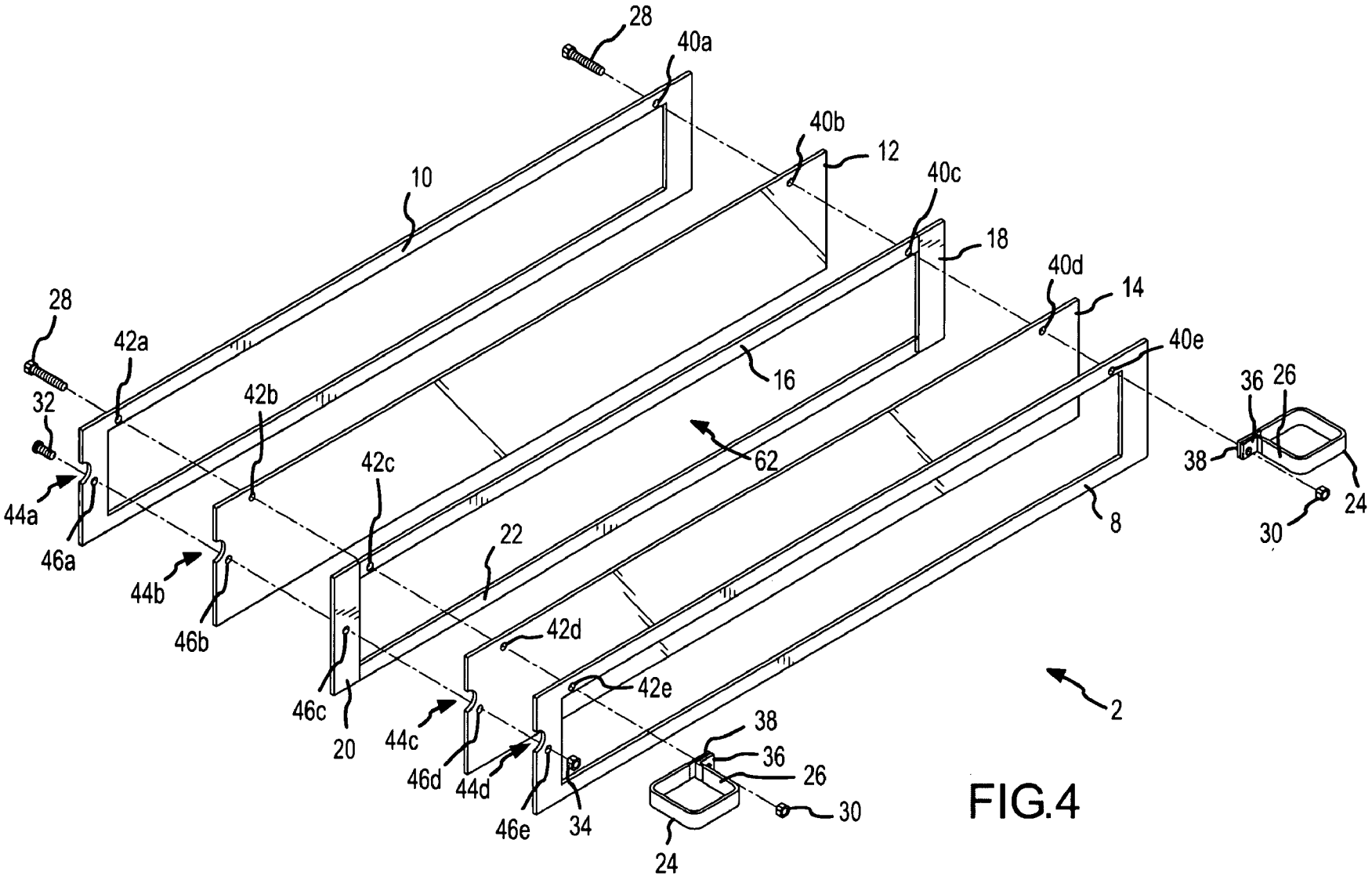
FIG. 4 is an exploded view of the components of the display panel of FIG. 1.
Figure 5A:
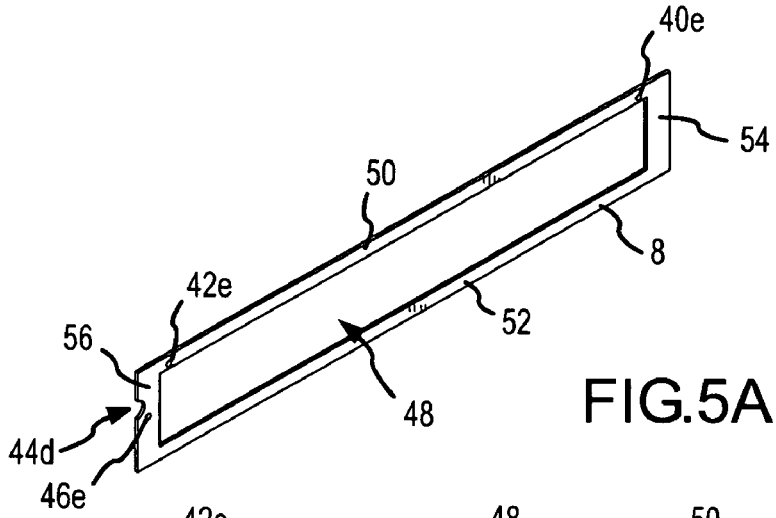
FIG. 5A is an isometric view of the front frame panel of the display panel of FIG. 1. The rear frame panel is identical to the front frame panel.
Figure 5B:
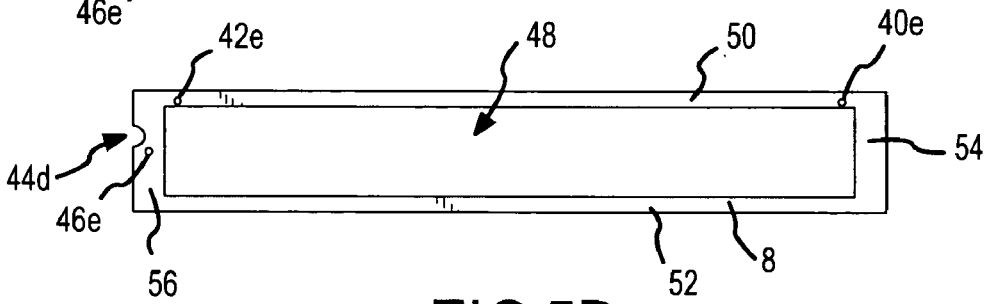
FIG. 5B is a front plan view of the front frame panel of FIG. 5A.

The front frame member 8 is shown in exemplary detail in FIGS. 5A and 5B. The front frame member 8 is composed of a top frame wall 50, a bottom frame wall 52, a right frame wall 54, and a left frame wall 56. The frame walls together define a rectangle which further defines a frame opening 48 in the front frame member 8. The top frame wall 50 further defines a right clamp bolt hole 40*e* and a left clamp bolt hole 42*e* positioned respectively toward the opposing lateral ends of the top frame wall 50. The left frame wall 56 also defines a left spacer bolt hole 46*e*, generally centered within the left frame wall 56. The left frame wall 56 further defines a tab recess 44*d* along the left edge of the left frame wall 56. Each of the front frame member 8 and the rear frame member 10 is identical to the other. Thus, while only the front frame member 8 is described in detail, each of the attributes described with respect to the front frame member 8 is equally applicable to the rear frame member 10. As, the rear frame member 10 is interchangeable with the front frame member 8, the rear frame member 10 thus defines identical apertures including a right clamp bolt hole 40*a*, a left clamp bolt hole 42*a*, a left spacer bolt hole 46*a*, and a tab recess 44*a*. (See, e.g., FIG. 4.)

Figure 6A:
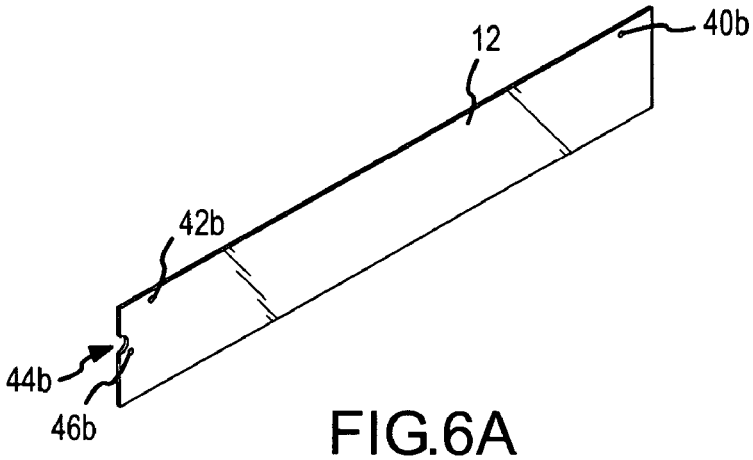
FIG. 6A is an isometric view of the rear transparent panel of the display panel of FIG. 1. The front transparent panel is identical to the rear transparent panel.
Figure 6B:
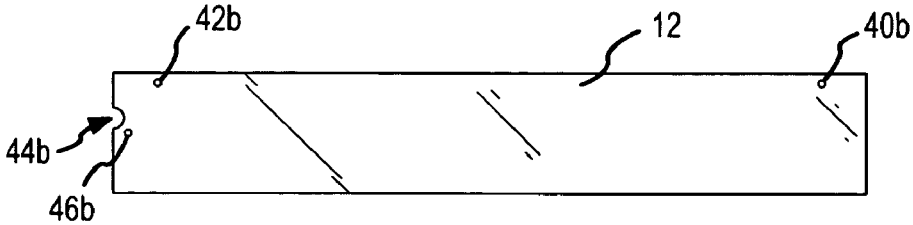
FIG. 6B is a front plan view of the rear transparent panel of FIG. 6A.

The rear transparent panel 12 is depicted in detail in FIGS. 6A and 6B. The rear transparent panel 12 is a thin flat panel of generally rectangular configuration. Adjacent a top edge of the rear transparent panel 12 are a right clamp bolt hole 40*b* adjacent to the right-hand side of the rear transparent panel 12 and a left clamp bolt hole 42*b* adjacent to the left-hand side of the rear transparent panel 12. Along the left edge of the rear transparent panel 12 is a semi circular tab recess 44*b*. Also along the left edge of the rear transparent panel 12 is a spacer bolt hole 46*b*. Each of the rear transparent panel 12 and the front transparent panel 14 is identical to the other. Thus, while only the rear transparent panel 12 is described in detail, each of the attributes described with respect to the rear transparent panel 12 is equally applicable to the front transparent panel 14. As, the front transparent panel 14 is interchangeable with the rear transparent panel 12, the front transparent panel 14 thus defines identical apertures including a right clamp bolt hole 40*d*, a left clamp bolt hole 42*d*, a left spacer bolt hole 46*d*, and a tab recess 44*c*. (See, e.g., FIG. 4.)

Figure 7A:
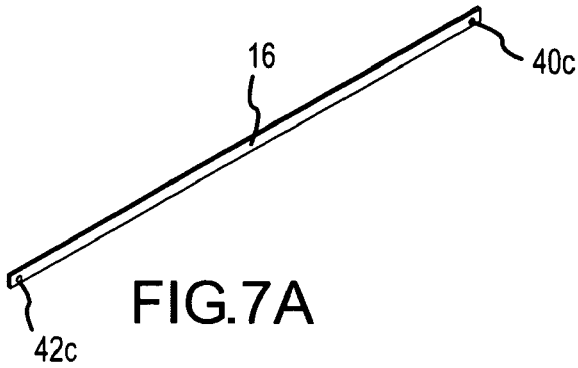
FIG. 7A is an isometric view of the top spacer member of the display panel of FIG. 1.
Figure 8A:
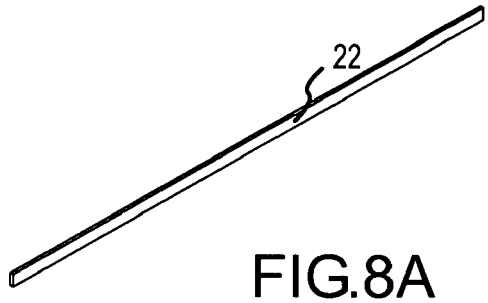
FIG. 8A is an isometric view of the bottom spacer member of the display panel of FIG. 1.
Figure 7B:
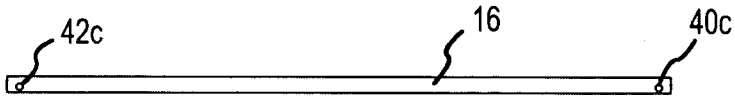
FIG. 7B is a front plan view of the top spacer member of FIG. 7A.
Figure 8B:
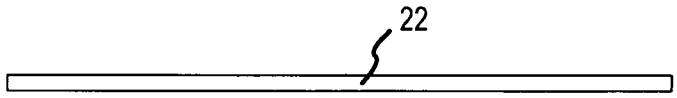
FIG. 8B is a front plan view of the bottom spacer member of FIG. 8A.

In addition to the frame members and the transparent panels, a collection of spacer members are used to form the display panel 2. FIGS. 7A and 7B depict a top spacer member 16, which is a long, thin, rectangular member defining a right clamp bolt hole 40*c* adjacent the right end and a left clamp bolt hole 42*c* adjacent the left end of the top spacer member 16. A bottom spacer member 22 is depicted in FIGS. 8A and 8B. The bottom spacer member 22 is generally the same as the top spacer member 16 in terms of its rectangular shape and is the same length and width as the top spacer member 16. However, the bottom spacer member 22 is solid and does not define any holes or other apertures within its body. The top spacer member 16 and the bottom spacer member 22 are equal in length and are equal to the length of each of the top and bottom edges of the frame opening 48 in the front frame member 8 and rear frame member 10.

Figure 9A:
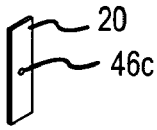
FIG. 9A is an isometric view of the left spacer member of the display panel of FIG. 1.
Figure 9B:
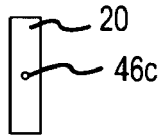
FIG. 9B is a front plan view of the left spacer member of FIG. 9A.
Figure 10A:
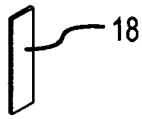
FIG. 10A is an isometric view of the right spacer member of the display panel of FIG. 1.
Figure 10B:
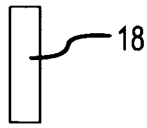
FIG. 10B is a front plan view of the right spacer member of FIG. 10A.

FIGS. 9A and 9B depict a left spacer member 20. The left spacer member 20 is rectangular in shape, is the same height as the frame members and the transparent panels, and is the same width as the left frame wall 56 of each of the front frame member 8 and rear frame member 10. The left spacer member 20 further defines a spacer bolt hole 46*c*, which may be positioned centrally within the left spacer member 20. The right spacer member 18, depicted in FIGS. 10A and 10B, is generally identical to the left spacer member 20 in size and shape. The right spacer member 18 is the same height as each of the frame members and transparent panels and is the same width as the right frame wall 54 of each of the front frame member 8 and the rear frame member 10. However, the right spacer member 18 is solid and does not define an aperture as defined in the left spacer member 20.

The top spacer member 16, the bottom spacer member 22, the left spacer member 20, and the right spacer member 18 may be positioned with respect to each other to form a rectangular panel. (See, e.g., FIG. 4.) The top spacer member 16 is positioned between the left spacer member 20 and the right spacer member 18 adjacent the top edge of each of the left spacer member 20 and the right spacer member 18. Similarly, the bottom spacer member 22 is positioned between the left spacer member 20 and the right spacer member 18 adjacent the bottom edge of each of the left spacer member 20 and the right spacer member 18. This component panel thus formed is generally the same size and shape as each of the front frame member 8 and the rear frame member 10. In an alternate embodiment (not shown), the top, bottom, and right spacer members could instead be a unitary structure defining an open, U-shaped space that to be capped by a separate left spacer member.

The construction of the display panel 2 is depicted in greater detail in FIG. 4. The top spacer member 16, right spacer member 18, left spacer member 20, and bottom spacer member 22 are arranged into a rectangle defining a space of the same size as the frame opening 48 and are placed between the rear transparent panel 12 and the front transparent panel 14. The front frame member 8 is placed adjacent the front transparent panel 14 and the rear frame member 10 is placed adjacent the rear transparent panel 12. Each of the right clamp bolt holes 40 in the components of the display panel 2 are aligned concentrically with each other. Similarly, each of the left clamp bolt holes 42 in the components of the display panel 2 are aligned concentrically with each other. Likewise, each of the spacer bolt holes 46 is aligned with adjacent spacer bolt holes and each of the tab recesses 44 is aligned with the other tab recesses, respectively. In this manner a sandwich of five layers is created to form the display panel 2.

In an exemplary embodiment, each of the frame members, transparent panels, and spacer members is composed of an acrylic sheet material, for example, poly methyl methacrylate. Acrylic sheet materials are generally weather-proof, fade resistant, and scratch resistant. Various commercial embodiments of such acrylic materials include Acrylite®FF (Cyro Industries, Inc.), Plexiglas® (Atoglas Atofina Chemicals, Inc.), and Lucite® (Lucite International). The acrylic sheet material used to make the components of the display panel 2 may be between 1/16" and 1/8" or thicker. While the rear transparent panel 12 and the front transparent panel 14 are clear or transparent sheets as indicated, the front frame member 8, the rear frame member 10, and each of the spacer members may be opaque in color in order to provide a visual frame border around the transparent panels.

Additionally, it is desirable to use an acrylic sheet material that filters ultraviolet (UV) radiation in order to protect the display material viewed through the transparent panels of the display panel 2. Although it amounts to only 3% of the total radiation that reaches the earth, UV radiation is energetic enough to cause chemical reactions, weathering of polymers, and fading of certain dyes. Wavelengths in the UV-B range of 290–315 nanometers cause the most photochemical degradation. To counter such degrading effects on both the display panel and the display materials inside, selection of an appropriate acrylic sheet material, for example, colorless Acrylite® FF sheets, which allow very small amounts of UV light transmission below 345 nanometers, may be desirable.

Each of the components of the display panel 2, excepting the left spacer member 20, is solvent welded to adjacent components of the display panel 2. An exemplary solvent may include methylene chloride, which is applied to adjacent surfaces of the components of the display panel 2 either directly or through capillary action as is well-known in the art. As the components of the display panel 2 are held together, the acrylic material of each of the components fuses with adjacent material as the solvent dissipates over time. In this manner, each of the top spacer member 16, right spacer member 18, and bottom spacer member 22 is welded between the rear transparent panel 12 and the front transparent panel 14. Similarly, the front frame member 8 is welded to the front surface of the front transparent panel 14 and the rear frame member 10 is welded the rear surface of the rear transparent panel 12. By solvent welding along the entire length of each of the top spacer member 16, right spacer member 18, and bottom spacer member 22, a cavity 62 with water-tight walls and an open end is formed by these spacer members between the front transparent panel 14 and the rear transparent panel 12.

Figure 11:
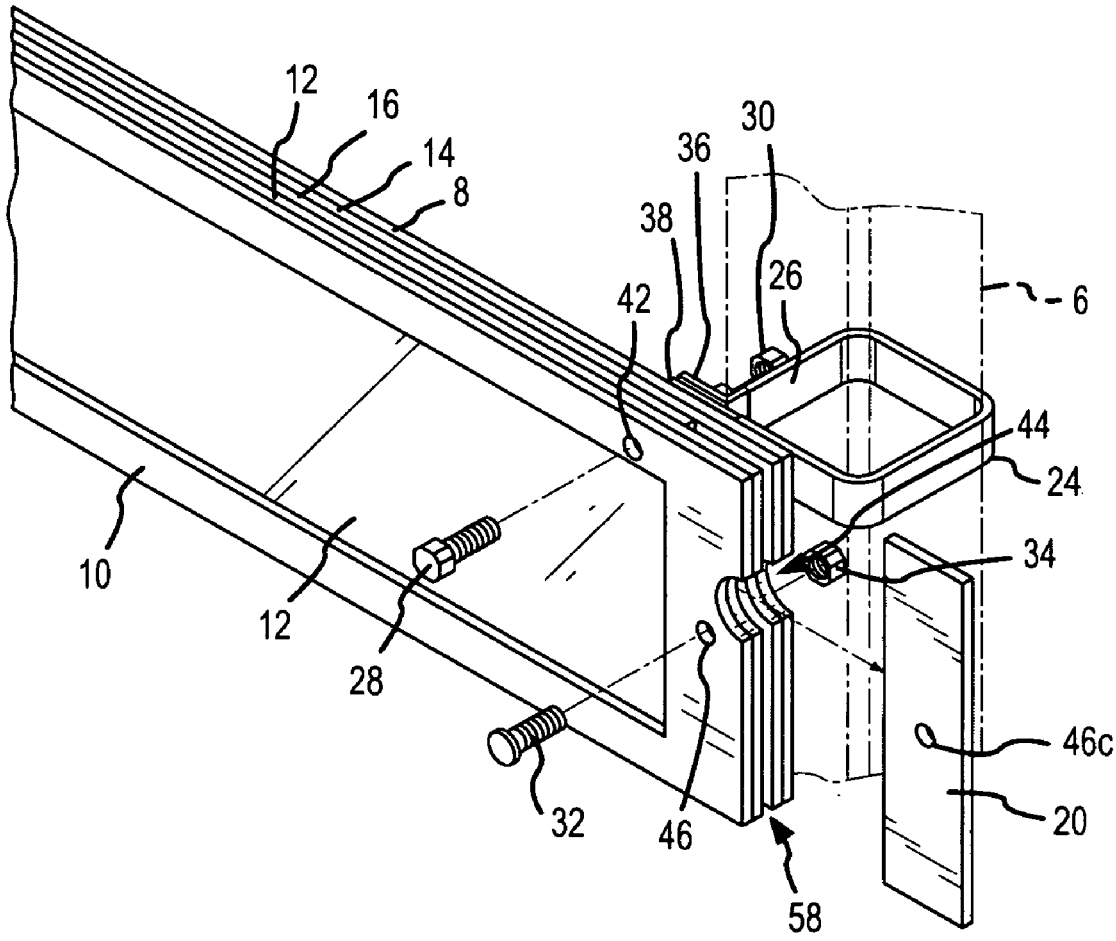
FIG. 11 is a magnified rear isometric view of the left side of the display panel of FIG. 1 detailing the removable feature of a left spacer member.

As seen to good advantage in FIG. 11, the left spacer member 20 is friction-fit within a spacer gap 58 between the front transparent panel 14 and the rear transparent panel 12. The left spacer member 20 provides a substantially weather-resistant seal against the only opening into the cavity 62 between the front transparent panel 14 and rear transparent panel 12. The left spacer member 20 may be further secured in place via spacer bolt 32 inserted within the spacer bolt holes 46 of the components of the display panel and secured by a spacer nut 34. The left spacer member 20 could likewise be secured by any other appropriate fastening device, for example, a pin, a plug, a clasp, a lock, or other fastener.

The display panel 2 may be mounted to the canopy supports 6 of the golf cart 4 via a pair of support clamps 24. Each support clamp 24 may be a single metal web bent into a shape that fits snuggly around the cross-sectional shape of the canopy support 6. In the embodiment depicted, for example, in FIGS. 1, 2, 4, and 11, the support clamps 24 are generally square in shape to fit around a square cross-section canopy support 6. The support clamps 24 are formed such that the ends of the metal web are positioned adjacent to each other and define a front clamp tab 36 and a rear clamp tab 38 extending parallel to the front face of the canopy support 6 and orthogonal to the interior face of the canopy support 6. The front clamp tab 36 and the rear clamp tab 38 each define an aperture that is concentric with the other aperture.

The front clamp tab 36 and the rear clamp tab 38 of the support clamp 24 are aligned with either the right clamp bolt hole 40 or the left clamp bolt hole 42 depending upon the side of the display panel 2 on which the support clamp 24 is mounted. Clamp bolts 28 are inserted through the right clamp bolt hole 40 and the left clamp bolt hole 42 and then through the apertures in the front clamp tab 36 and rear clamp tab 38 of the support clamps 24. The clamp bolts 28 further secured with nuts 30 in order to secure the support clamps 24 to the display panel 2.

It should be noted that the support clamps 24 should be sufficiently flexible in order to open a gap between the front clamp tab 36 and rear clamp tab 38 to fit around the canopy support 6, while also resilient to then return to the preferred shape to fit snuggly around the exterior surface of the canopy support 6. In order to and insure a tight friction-fit around the canopy support 6 and thus prevent any movement of the display panel 2, the support clamp 24 may be covered with or coated by a grip-sleeve 26. The grip-sleeve 26 may be made of rubber or other similar minimally compressible weather-resistant covering or coating with a good co-efficient of friction against the metal canopy support 6.

In an alternate embodiment (not depicted), the display panel may be attached to the canopy supports using a second pair of support clamps mounted along the bottom edge of the display panel, one at each lateral end. The second set of support clamps may be identical to the support clamps 24 and may be fastened to the display panel using bolts inserted through additional holes in the bottom edge of the display panel. In another embodiment (not shown), the support clamps may be in the form of sleeves extending the entire height of the display panel. The sleeve may be formed in the same cross-sectional shape as the canopy support in order to fit tightly about the canopy support. The sleeve may have clamp tabs extending along its length and may be attached to the display panel with bolts, in a similar manner as the support clamps 24, to both the top and bottom edges of the display panel. In yet a further embodiment (not shown), the support clamps may additionally have a tightening mechanism to increase the tension of the support clamps about the canopy supports. Exemplary tightening mechanisms may include a worm or screw drive similar to a hose clamp or a ratchet mechanism, each of which would operate to further tighten the support clamps against the canopy supports. Each of these alternate clamp designs may be desirable in order to ensure the display panel is firmly mounted to the canopy supports.

Figure 12:
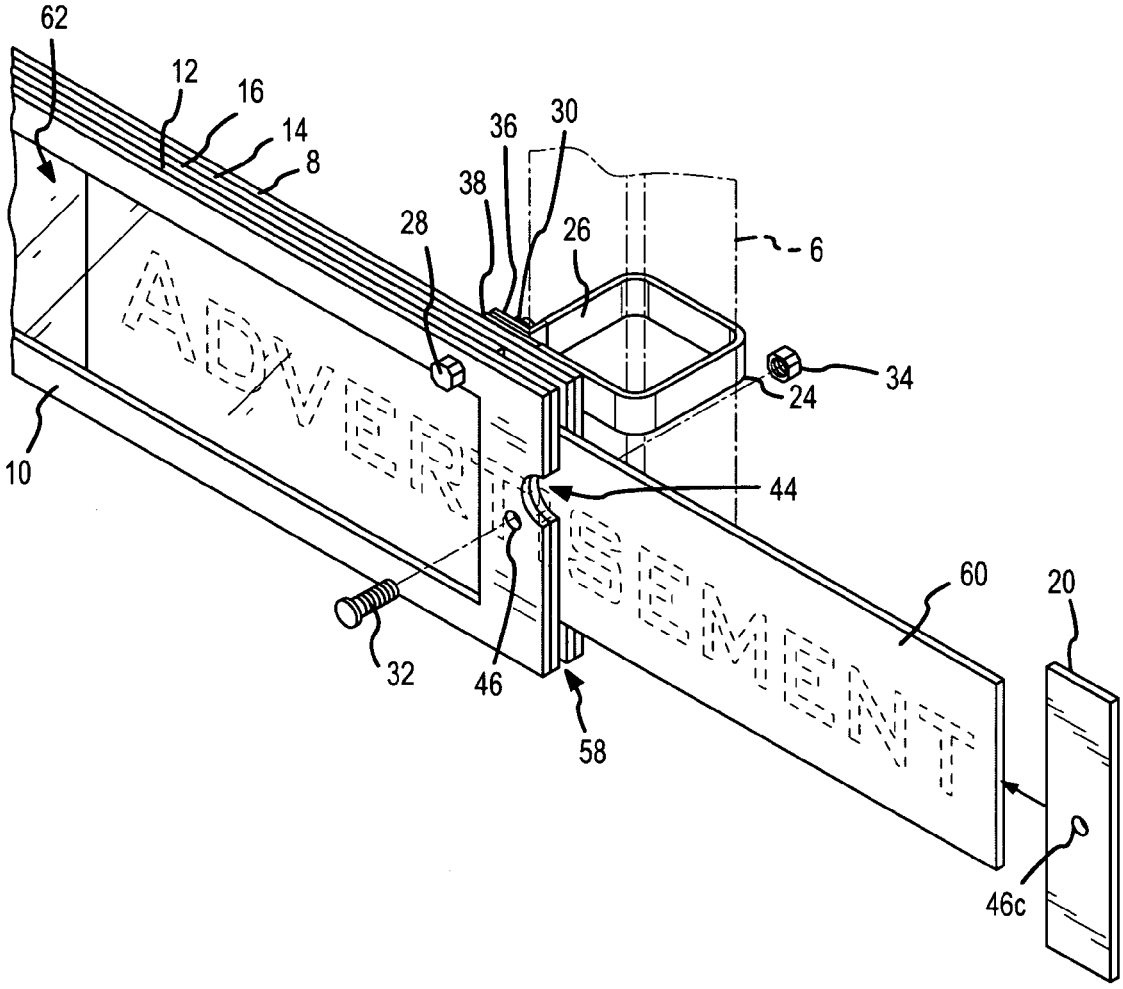
FIG. 12 is a magnified rear isometric view of the left side of the display panel of FIG. 1 schematically depicting the insertion or removal of a display sheet within the display panel.

FIG. 12 depicts the insertion or removal of a display sheet 60 of identification, informational, or advertising material that resides within the cavity 62 of the display panel 2. In order to insert a display sheet 60 into the display panel 2, the spacer nut 34 is loosened from the spacer bolt 32 and the spacer bolt 32 is removed from the spacer bolt hole 46 in the display panel 2. The left spacer member 20 may then be grasped by a user's fingers via the tab recess 44 in the display panel 2 exposing the outer edge of the left spacer member 20. Once the left spacer member 20 is removed, access is provided to the cavity 62 by a gap 58 between the front transparent panel 14 and rear transparent 12 of the display panel 2.

The display sheet 60 may be printed on a front side with identification material, for example, the name of a golf course, and on the rear side with advertising and/or informational material, for example, advertisements directed at golfers or information about the golf course. The display sheet 60 may be sized to such rectangular dimensions as to both fit within and fill up the cavity 62. In this manner, the identification, informational, or advertising material maybe seen within the display panel 2 through both the rear transparent panel 12 and the front transparent panel 14. The display sheet 60 is preferable printed using UV resistant ink to reduce the potential for the printed material on the display sheet 60 from fading due to extending exposure to the sun.

It should be recognized that the cavity 62 may be provided with two display sheets, one for viewing out of the front transparent panel 14 and a second for viewing through the rear transparent panel 12. For example, a first display sheet may be considered a "permanent" display sheet with a name and insignia of the golf course exposed through the front transparent 12 while a second display sheet may be provided for viewing through the rear transparent 12 may be regularly replaced in order to change or update the advertisements or information. By maintaining a static display sheet viewable through one of the transparent panels, printing costs for replacement display sheets may be reduced.

Once the display sheet 60 is inserted into the cavity 62, the left spacer member 20 may be inserted into the gap 58 between the rear transparent panel 12 and the front transparent panel 14, creating a weather resistant seal. The spacer bolt 32 may then be reinserted into the spacer bolt hole 46 and fastened with the spacer nut 34. Should the golf course desire to change the advertising or information in the display panel 2, the left spacer member 20 may be removed as previously described, the display sheet 60 extracted from the cavity 62, and replaced with a new display sheet printed with alternative information or advertising material.

In an alternative embodiment of the invention, the display panel may be integrated into the construction of the canopy. Generally, golf cart canopies are formed of a molded plastic material that is mounted to the tops of the canopy supports. In this embodiment, the front edge of the canopy may be molded to extend downward between the front canopy supports and form a frame. The transparent panels may then be affixed to the frame in the canopy for accepting and protecting display material. The display material may be inserted through an opening on a side of the frame portion of the canopy and be positioned between the transparent panels.

In a further embodiment of the invention, the display panel may be integrated into a windshield mounted between the front canopy supports of the golf cart. Generally, golf cart windshields are either made of a single sheet of molded transparent acrylic, which spans that opening between the front canopy supports between the dashboard of the golf cart and the canopy, or of two sheets of molded transparent acrylic that are hinged together. A single sheet windshield may be formed to include a framed cavity at the top of the windshield adjacent the canopy for insertion of the display material. In a two-part windshield, one acrylic sheet forms a bottom half and is fixed to the golf cart between the canopy supports. The second acrylic sheet is mounted to the bottom sheet on hinges and may be removably mounted at its top to the canopy supports adjacent the canopy. The hinges allow the top sheet to rotate forward and downward to fold against the bottom half of the windshield. In this embodiment the bottom half of the windshield may be formed to include a framed cavity adjacent the interface with the top half of the windshield for insertion of the display material. In this manner the display material facing rearward toward the occupants of the golf cart is always viewable and is exhibited at a height slightly above the steering wheel, while not obscuring the view of the driver. The display material facing forward is viewable through the transparent top half of the windshield when it is folded down against the bottom half of the windshield as well as when the top half of the windshield is up and connected to the canopy supports.

Although various embodiments of this invention have been described above with a certain degree of particularity, or with reference to one or more individual embodiments, those skilled in the art could make numerous alterations to the disclosed embodiments without departing from the spirit or scope of this invention. It is intended that all matter contained in the above description and shown in the accompanying drawings shall be interpreted as illustrative only of particular embodiments and not limiting. All directional references (e.g., upper, lower, upward, downward, left, right, lateral, front, back, top, bottom, above, below, vertical, and horizontal) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the basic elements of the invention as defined in the following claims.

What is claimed is:

1. A golf cart display panel comprising a first transparent panel;

a second transparent;

at least one fixed spacer member positioned between the first transparent panel and the second transparent panel;

a removable spacer member functionally positioned between the first transparent panel and the second transparent panel; wherein the first transparent panel is adhered to a perimeter of the at least one fixed spacer member;

the second transparent panel is adhered to the perimeter of the at least one fixed spacer member;

a cavity is defined between the first transparent panel, the second transparent panel, and the at least one fixed spacer member; and the removable spacer member seals the cavity when positioned between the first transparent panel and the second transparent panel and affords access to the cavity when removed from between the first transparent panel and the second transparent panel.

2. The golf cart display panel of claim 1 further comprising a first frame member; and a second frame member; wherein the first frame member is adhered to the first transparent panel opposite the at least one fixed spacer member;

the second frame member is adhered to the second transparent panel opposite the at least one fixed spacer member.

3. The golf cart display panel of claim 2, wherein each of the first frame member, the second frame member, the fixed spacer member, the first transparent panel, and the second transparent panel are composed of an acrylic sheet material.

4. The golf cart display panel of claim 3, wherein the first frame member, the second frame member, the fixed spacer member, the first transparent panel, and the second transparent panel are each adhered by a solvent weld.

5. The golf cart display panel of claim 3, wherein the first frame member and the second frame member are composed of an opaque acrylic sheet material.

6. The golf cart display panel of claim 2 further comprising a first clamp attached to a first lateral end of the display panel; and a second clamp attached to a second lateral end of the display panel.

7. The golf cart display panel of claim 2, wherein the first frame member and the second frame member are composed of an opaque material.

8. The golf cart display panel of claim 1, wherein each of the first transparent panel, the second transparent panel, and the fixed spacer member are composed of an acrylic sheet material.

9. The golf cart display panel of claim 8, wherein the first transparent panel, the second transparent panel, and the fixed spacer member are each adhered by a solvent weld.

10. The golf cart display panel of claim 8, wherein the acrylic sheet material is substantially opaque to ultraviolet B radiation.

11. The golf cart display panel of claim 8, wherein the first transparent panel and the second transparent panel are composed of poly methyl methacrylate.

12. The golf cart display panel of claim 1, wherein the at least one fixed spacer member comprises a top spacer member, a bottom spacer member, and a side spacer member.

13. The golf cart display panel of claim 1 further comprising a display sheet removably positioned between the first transparent panel and the second transparent panel.

14. The golf cart display panel of claim 1 further comprising a first clamp attached to a first lateral end of the display panel; and a second clamp attached to a second lateral end of the display panel.

15. A golf cart display panel comprising a first frame member;

a second frame member;

at least one fixed spacer member positioned between the first frame member and the second frame member;

a first transparent panel positioned between the first frame member and the at least one spacer member;

a second transparent panel positioned between the second frame member and the at least one spacer member;

a removable spacer member fUnctionally positioned between the first transparent panel and the second transparent panel; wherein the first frame member is adhered to the first transparent panel;

the second frame member is adhered to the second transparent panel;

the first transparent panel is adhered to a perimeter of the at least one fixed spacer member;

the second transparent panel is adhered to the perimeter of the at least one fixed spacer member;

a cavity is defined between the first transparent panel, the second transparent panel, and the at least one fixed spacer member; and the removable spacer member seals the cavity when positioned between the first transparent panel and the second transparent panel and affords access to the cavity when removed from between the first transparent panel and the second transparent panel.

16. The golf cart display panel of claim 15 farther comprising a first clamp attached to a first lateral end of the display panel; and a second clamp attached to a second lateral end of the display panel.

17. golf cart display panel of claim 16, wherein each of the first clamp and the second clamp are formed in a shape adapted to conform to a perimeter surface defined about a cross-section of a golf cart canopy support.

18. The golf cart display panel of 16 further comprising gripping material covering at least a portion of each of the first clamp and the second clamp.

19. The golf cart display panel of claim 15, wherein the first frame member and the second frame member are composed of an opaque material.

20. A weather-resistant golf cart display panel comprising an elongate container having opposing transparent walls and defining a cavity accessible via a single opening in one lateral end of the elongate container, wherein the cavity is adapted to house a flat display sheet; and excepting the single opening, the elongate container is impervious to moisture;

a spacer member adapted for insertion into the single opening, wherein the spacer member substantially seals the cavity from ingress of moisture; and a pair of clamps attached respectively to each lateral end of the elongate container and adapted to connect to a canopy support of a golf cart.

21. The weather-resistant golf cart display panel of claim 20 further comprising at least one opaque frame member defining the perimeter of at least one of the opposing transparent walls.

22. The weather-resistant golf cart display panel of claim 20, wherein the elongate container is substantially opaque to ultraviolet B radiation.

* * * * *

UNITED STATES PATENT AND TRADEMARK OFFICE

CERTIFICATE OF CORRECTION

PATENT NO. : 7,207,129 B2
APPLICATION NO. : 10/974261
DATED : April 4, 2007
INVENTOR(S) : Buchanan et al.

It is certified that error appears in the above-identified patent and that said Letters Patent is hereby corrected as shown below:

In claim 1, on line 40, please change "a second transparent" to --a second transparent panel--

In claim 15, on line 57, please change "fUnctionally positioned" to --functionally positioned--

In claim 16, on line 9, please change "farther comprising" to --further comprising--

In claim 17, on line 15, please change "golf cart" to --The golf cart--

Signed and Sealed this

Fourteenth Day of August, 2007

JON W. DUDAS
*Director of the United States Patent and Trademark Office*